US009332844B2

(12) United States Patent
Regev

(10) Patent No.: US 9,332,844 B2
(45) Date of Patent: May 10, 2016

(54) ELECTRICALLY CONTROLLED RECLINER WITH INDEPENDENT ROCKER-LIMITING MECHANISM

(71) Applicant: Aminach, Nir Tzvi (IL)

(72) Inventor: Yizhak Regev, Nir Tzvi (IL)

(73) Assignee: AMINACH BEDDING & FURNITURE MANUFACTURING LTD., Ramle (IL)

( * ) Notice: Subject to any disclaimer, the term of this patent is extended or adjusted under 35 U.S.C. 154(b) by 55 days.

(21) Appl. No.: 14/509,115

(22) Filed: Oct. 8, 2014

(65) Prior Publication Data

US 2016/0100686 A1 Apr. 14, 2016

(51) Int. Cl.

| | |
|---|---|
| ***A47C 1/02*** | (2006.01) |
| ***A47C 1/024*** | (2006.01) |
| ***A47C 3/025*** | (2006.01) |
| ***A47C 7/50*** | (2006.01) |

(52) U.S. Cl.
CPC ..... *A47C 1/0242* (2013.01); *A47C 3/025* (2013.01); *A47C 7/506* (2013.01)

(58) Field of Classification Search
CPC ..... A47C 1/0242; A47C 3/025; A47C 7/506
USPC ..... 297/69, 68, 84, 85, 330
See application file for complete search history.

(56) References Cited

U.S. PATENT DOCUMENTS

| | | | | |
|---|---|---|---|---|
| 3,096,121 | A * | 7/1963 | Knabusch | A47C 1/0355 297/269.1 |
| 4,386,803 | A * | 6/1983 | Gilderbloom | A47C 1/022 297/330 |
| 4,691,964 | A * | 9/1987 | Morgan | A47C 1/0242 297/330 |
| 5,098,158 | A * | 3/1992 | Palarski | A47C 1/022 279/234 |
| 6,492,786 | B1 * | 12/2002 | Vang | A61G 5/14 280/647 |
| 6,659,562 | B2 * | 12/2003 | Uchiyama | A47C 7/506 297/217.3 |
| 8,979,186 | B2 * | 3/2015 | Walz | A47C 1/0242 297/68 |
| 8,991,925 | B2 * | 3/2015 | LaPointe | A61G 5/14 297/325 |
| 2008/0018157 | A1 * | 1/2008 | Dewert | A47C 1/0242 297/354.12 |
| 2010/0127538 | A1 * | 5/2010 | Hoffman | A47C 1/0355 297/68 |
| 2011/0245979 | A1 * | 10/2011 | Koch | A47C 1/0242 700/275 |
| 2013/0062914 | A1 * | 3/2013 | Marshall | A47C 7/506 297/69 |
| 2014/0333099 | A1 * | 11/2014 | Lu | A47C 1/0355 297/83 |

* cited by examiner

*Primary Examiner* — Laurie K Cranmer
(74) *Attorney, Agent, or Firm* — Mark M. Friedman

(57) ABSTRACT

A recliner has a chassis relative to which a seat, a backrest and a leg rest are supported. Electrically controlled recliner and leg rest mechanisms displace the backrest and leg rest between sitting and reclining states. The chassis is supported via a rocker mechanism on a base so as to allow rocking of the chassis relative to the base from a neutral position alternately towards a forward-tipped position and a rearward-tipped position. An electrically controlled rocker-limiting mechanism is deployed such that progressive actuation of the rocker-limiting mechanism deploys from a neutral state in which the chassis is free to rock through an intermediate state in which the chassis is free to rock within only a limited range to a final state in which the chassis is forced into a rearward-tipped position.

4 Claims, 7 Drawing Sheets

ELECTRICALLY CONTROLLED RECLINER WITH INDEPENDENT ROCKER-LIMITING MECHANISM

FIELD AND BACKGROUND OF THE INVENTION

The present invention relates to recliners and, in particular, it concerns an electrically controlled recliner with an independent rocker-limiting mechanism.

It is known to provide a recliner in which a back rest moves from an upright position to a reclining position and a leg rest opens from a folded state to an extended state. Over the years, the design of such recliners has become standardized, with most recliners still employing structures basically similar to those disclosed more than half a century ago in U.S. Pat. No. 3,096,121 for the back rest reclining adjustment, a center-biased rocker mechanism, and a lever-based deployment mechanism for the leg rest.

More recently, some recliners have been adapted to use electric actuators to control the motion.

SUMMARY OF THE INVENTION

The present invention is an electrically controlled recliner with an independent rocker-limiting mechanism.

According to the teachings of an embodiment of the present invention there is provided, a recliner comprising: (a) a base; (b) a chassis supported via a rocker mechanism on the base so as to allow rocking of the chassis relative to the base from a neutral position alternately towards a forward-tipped position and a rearward-tipped position; (c) a seat, a backrest and a leg rest supported relative to the chassis; (d) an electrically controlled recliner mechanism including a first electrical actuator deployed for displacing the backrest between an upright position and a reclining position relative to the chassis; (e) an electrically controlled leg rest mechanism including a second electrical actuator deployed for displacing the leg rest between a folded position and an extended position; and (f) an electrically controlled rocker-limiting mechanism including a third electrical actuator, the rocker-limiting mechanism being deployed such that progressive actuation of the rocker-limiting mechanism deploys from a neutral state in which the chassis is free to rock from the forward-tipped position to the rearward-tipped position through an intermediate state in which the chassis is free to rock within a limited range from the rearward-tipped position towards the neutral position to a final state in which the chassis is forced into a rearward-tipped position.

According to a further feature of an embodiment of the present invention, the electrically controlled rocker-limiting mechanism is operable independently of both the recliner mechanism and the leg rest mechanism.

According to a further feature of an embodiment of the present invention, the first electrical actuator is deployed to displace the seat along a track, and wherein the back rest is connected to the seat via a linkage such that sliding of the seat along the track causes displacement of the back rest from the upright position to the reclining position.

According to a further feature of an embodiment of the present invention, when the recliner mechanism brings the backrest to the reclining position, the leg rest mechanism brings the leg rest to the extended position and the rocker-limiting mechanism including a third electrical actuator, the rocker-limiting mechanism brings the chassis to the rearward-tipped position, the seat, the backrest and the leg rest define a user body position in which a user's feet are raised to within +/−15 cm of the level of the user's head.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
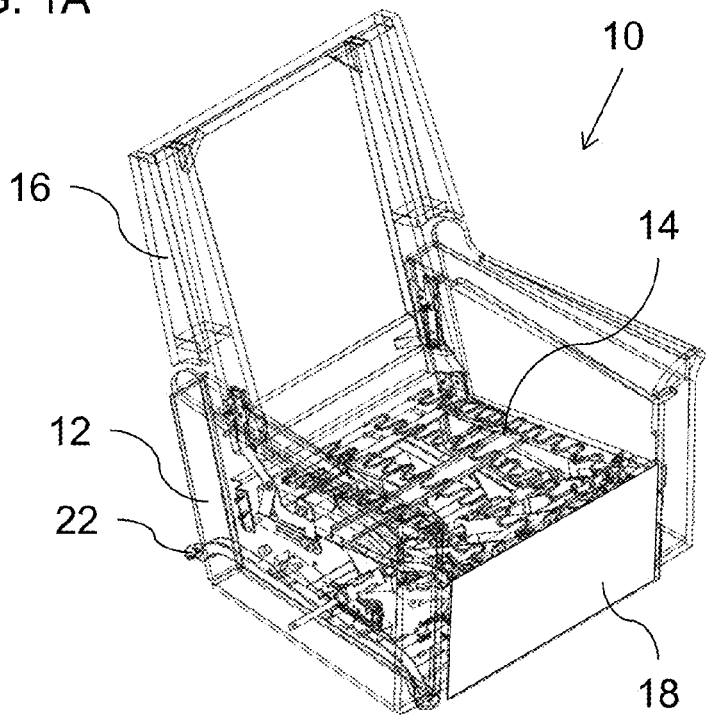
FIGS. 1A and 1B are isometric views of a recliner (upholstery removed), constructed and operative according to the teachings of an embodiment of the present invention, shown in an upright/folded state and a reclining/open state, respectively.

The present invention is an electrically controlled recliner with an independent rocker-limiting mechanism.

The principles and operation of recliners according to the present invention may be better understood with reference to the drawings and the accompanying description.

Referring now to the drawings, FIGS. 1A-7 illustrate various aspects of a recliner, generally designated 10, constructed and operative according to an embodiment of the present invention.

Figure 1B:
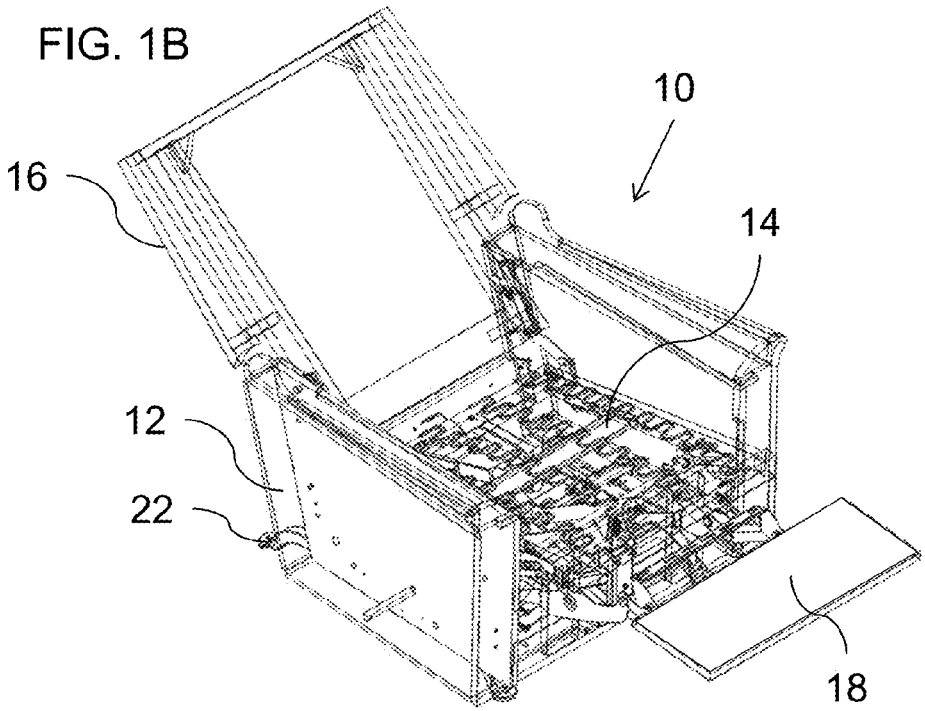

As seen in FIGS. 1A and 1B, recliner 10 has a chassis 12 relative to which a seat 14, a backrest 16 and a leg rest 18 are supported. An electrically controlled recliner mechanism, discussed further below, is deployed for displacing backrest 16 between an upright position (FIG. 1A) and a reclining position (FIG. 1B) relative to chassis 12. An electrically controlled leg rest mechanism, discussed further below, is deployed for displacing leg rest 18 between a folded position (FIG. 1A) and an extended position (FIG. 1B). The leg rest mechanism and the recliner mechanism are preferably independently operable and adjustable, although a user control for operating them simultaneously may optionally be provided.

Figure 2A:
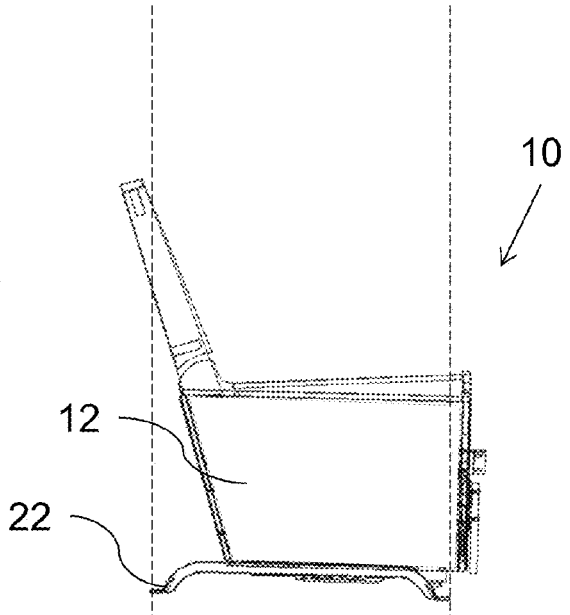
FIGS. 2A-2C are side views of the recliner of FIG. 1A shown in a neutral position, a forward-tipped position and a rearward-tipped position, respectively, to illustrate a range of rocker positions.
Figure 2B:
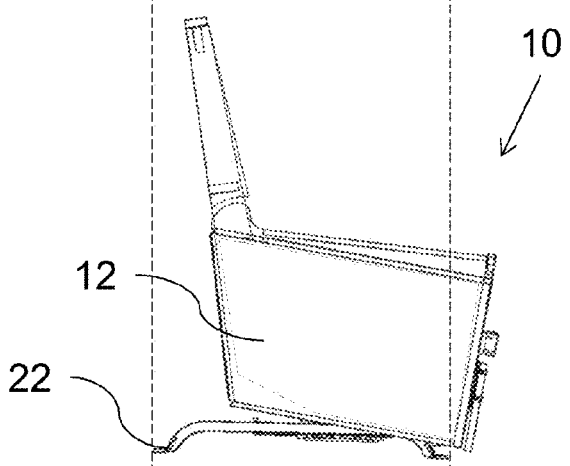
Figure 2C:
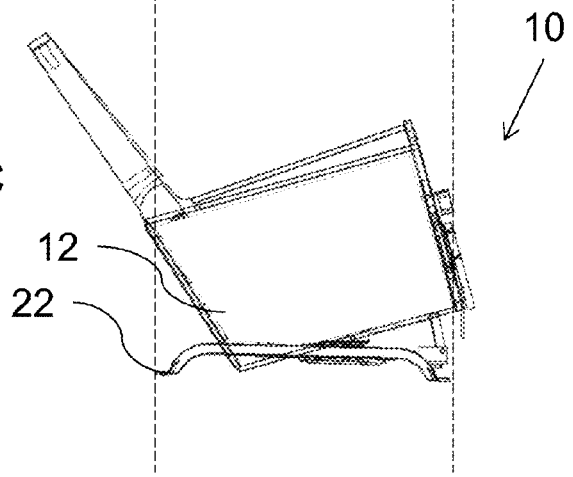
Figure 2D:
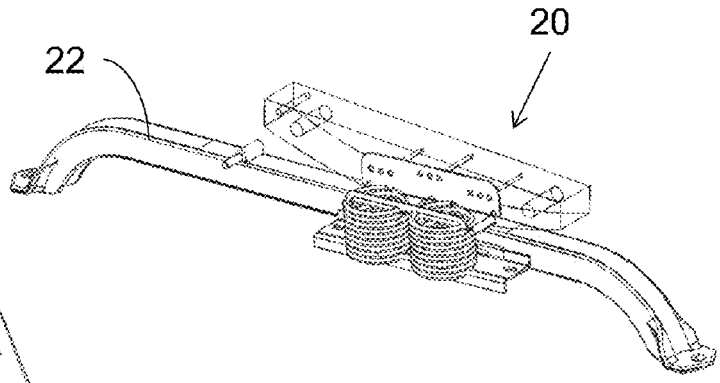
FIG. 2D is an isometric view of one side of a rocker mechanism from the recliner of FIG. 1A to allow rocking of the recliner chassis relative to a base of the recliner.
Figure 3A:
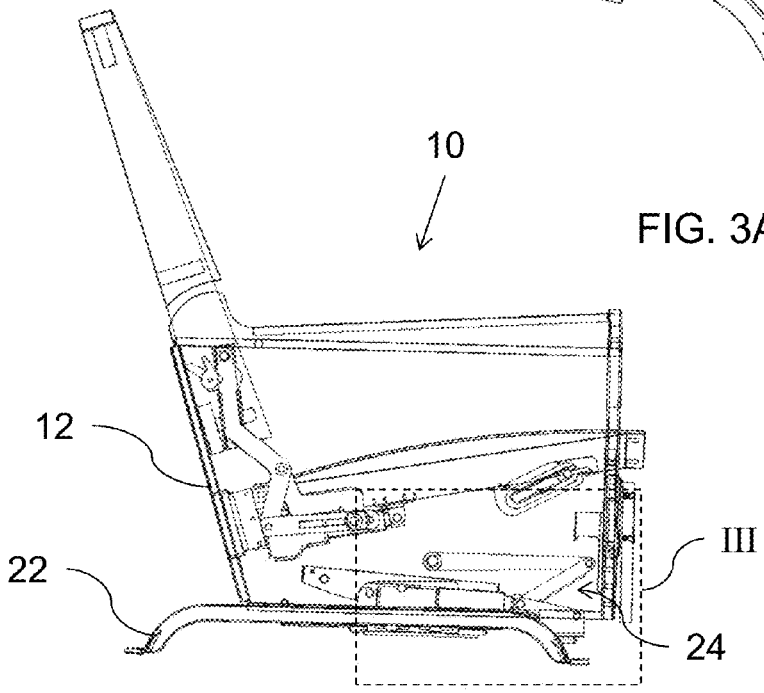
FIGS. 3A and 3B are side views of the recliner of FIG. 1A with a side panel and various internal components removed to reveal a rocker-limiting mechanism in a neutral state and in a fully deployed state, respectively.
Figure 3B:
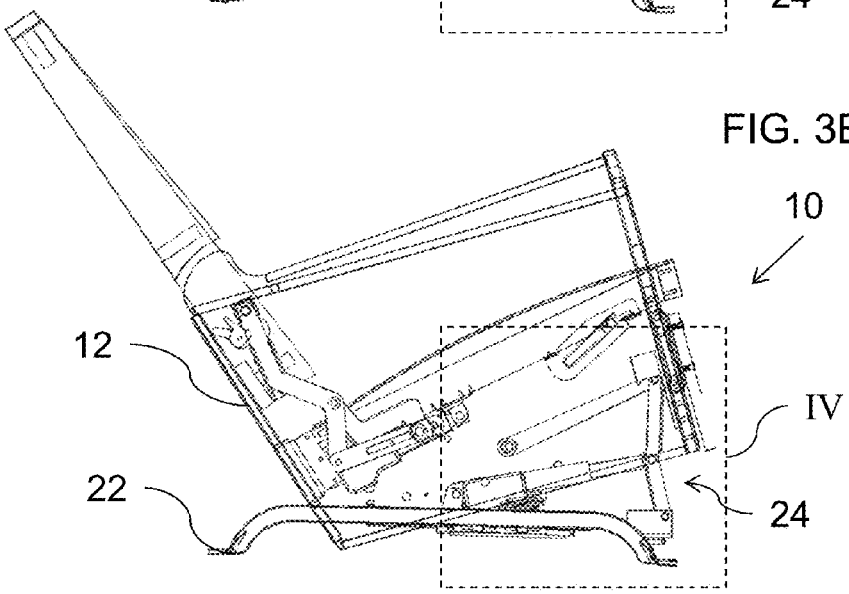

Chassis 12 is supported via a rocker mechanism 20 on a base 22, best seen in FIG. 2D, so as to allow rocking of the chassis relative to the base from a neutral position (FIG. 2A) alternately towards a forward-tipped position (FIG. 2B) and a rearward-tipped position (FIG. 2C). The rocker mechanism is similar to mechanisms common in rocking recliner chairs, such as, for example, the aforementioned U.S. Pat. No. 3,096,121 (hereafter "the '121 patent"), and need not be described here in detail.

An electrically controlled rocker-limiting mechanism 24 (FIGS. 3A-4C) is deployed such that progressive actuation of rocker-limiting mechanism 24 deploys from a neutral state (FIGS. 4A and 4B) in which chassis 12 is free to rock from the forward-tipped position to the rearward-tipped position, through an intermediate state in which the chassis is free to rock within a limited range from the rearward-tipped position towards the neutral position, to a final state (FIG. 4C) in which the chassis is forced into a rearward-tipped position.

At this point, it will be appreciated that the present invention provides particularly advantageous control over the function of recliner 10. Specifically, by separating control of the rocker-limiting mechanism 24 from the recliner mechanism and the leg rest adjustment mechanism, the user has more flexibility to adjust the state of the recliner, for example, allowing deployment of the recliner mechanism and/or leg rest while maintaining a relatively upright overall body position, and then allowing separate adjustment to move to a near-horizontal body position when desired. This and other advantages of the present invention will become clearer from the following description with reference to the attached drawings.

Figure 5A:
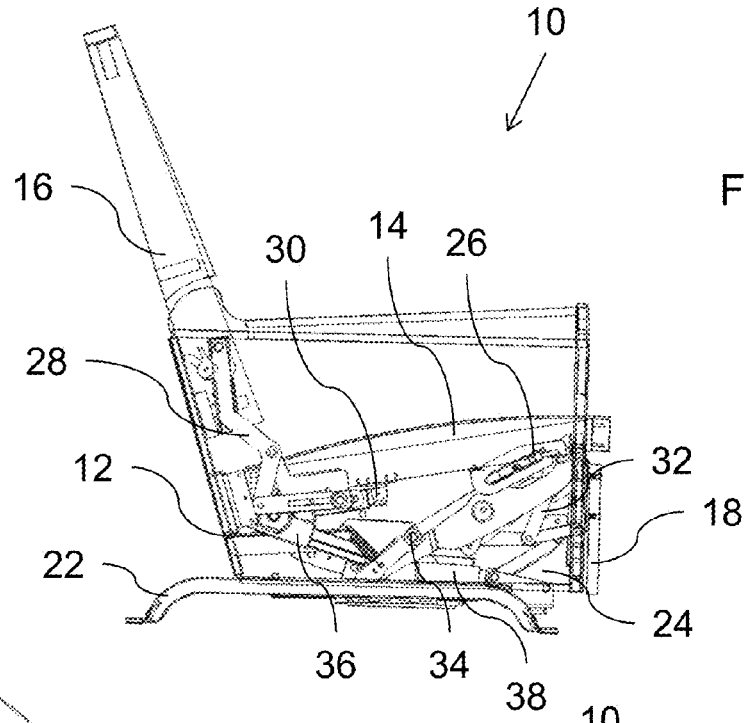
FIGS. 5A and 5B are side views of the recliner of FIG. 1A with a side panel removed showing the recliner in the upright/folded state and the reclining/open state, respectively.
Figure 5B:
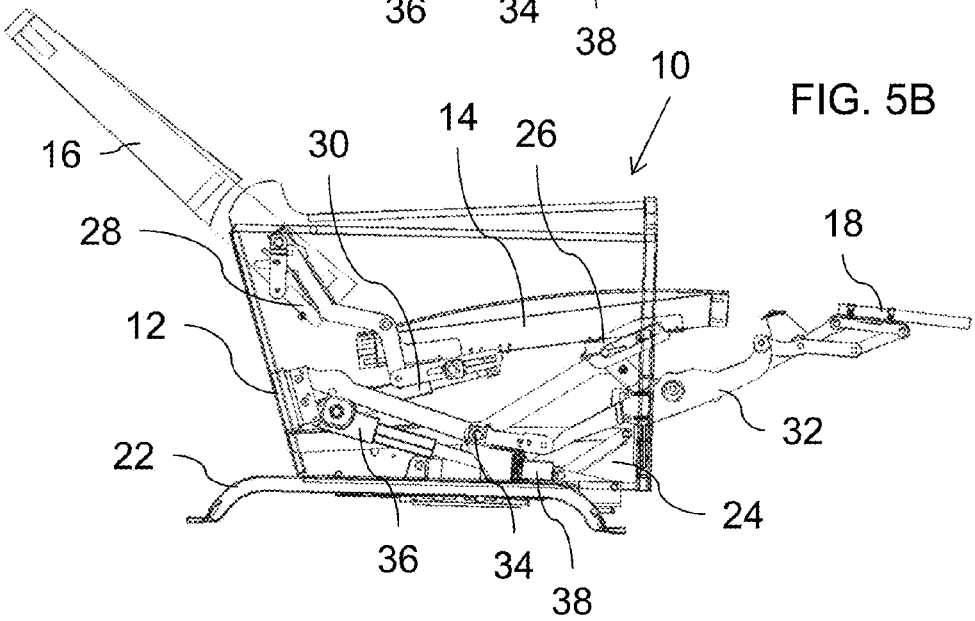

Turning now to the recliner mechanism and the leg rest mechanism, these are best see in FIGS. 5A and 5B. In a preferred implementation of the recliner mechanism, seat 14 slides forward along a track, defined here by a pin engaging a slotted member 26. Backrest 16 is connected to seat 14 via a linkage 28 such that sliding of seat 14 forwards along the track causes displacement of backrest 16 from the upright position (FIG. 5A) to the reclining position (FIG. 5B). This mechanism is similar to mechanisms common in mechanical recliners dating back many years (e.g., the aforementioned '121 patent), and need not be described here in any detail. The recliner mechanism includes a first electrical actuator 30, deployed to displace seat 14 along the track, so as to control bidirectional movement between the reclining and upright states.

The leg rest mechanism is also based on a lever arrangement which is fundamentally similar to the leg rest mechanisms commonly used in mechanical recliners, such as the '121 patent, and need not be described in detail. A system of levers 32 is operated by rotation of a lateral main shaft 34 to displace foot rest 18 between a folded position (FIG. 5A) and an extended position (FIG. 5B). The leg rest mechanism includes a second electrical actuator 36, in this case implemented as a linear actuator pivotally connected so as to act on an off-axis linkage connected to shaft 34 so that extension and retraction of the actuator rotates shaft 34, thereby displacing the leg rest bidirectionally between the folded position and the extended position. Most preferably, the retracting force is applied via a spring linkage so as to avoid damage or injury that might otherwise be caused by obstruction of the mechanism during folding.

Rocker-limiting mechanism 24 includes a third electrical actuator 38. The operation of mechanism 24 is best understood with reference to FIGS. 4A-4C. In the implementation shown here, actuator 38 acts on the elbow of a toggle joint 40 which is anchored at its lower end to base 22 and at its upper end supports a stopper, for example, a transverse pin 42, which selectively engages a bracket 44 mounted to chassis 12. The path of motion of the stopper 42 as toggle joint 40 opens is further defined by connection of the top end of the toggle joint to a lever 46 pivotally mounted so as to define a curved path of motion generally following the rocking motion path of bracket 44.

Figure 4A:
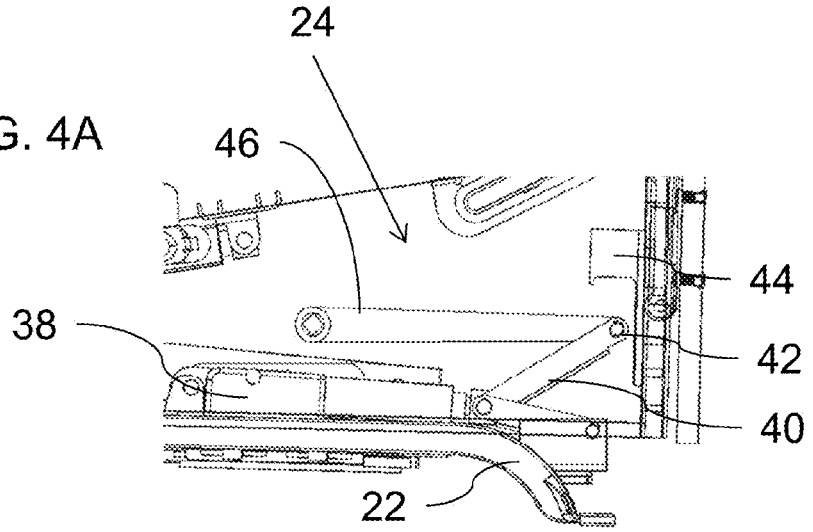
FIGS. 4A and 4B are enlarged views of the region of FIG. 3A designated III, with the recliner shown in a neutral rocking position and a forward-tipped rocking position, respectively.
Figure 4B:
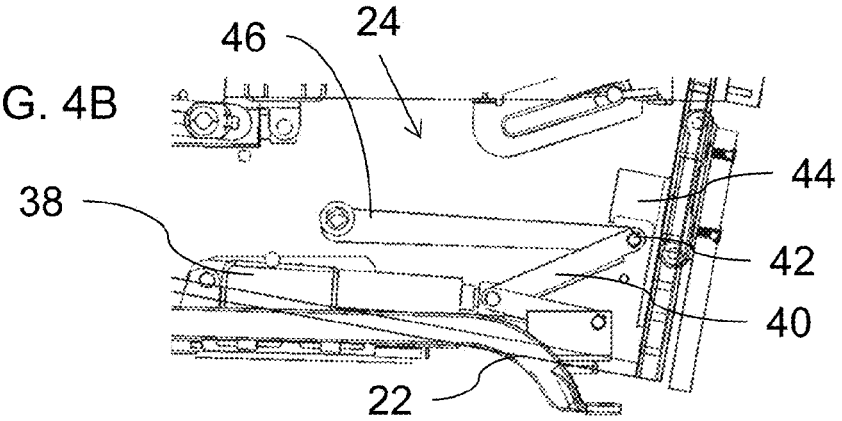
Figure 4C:
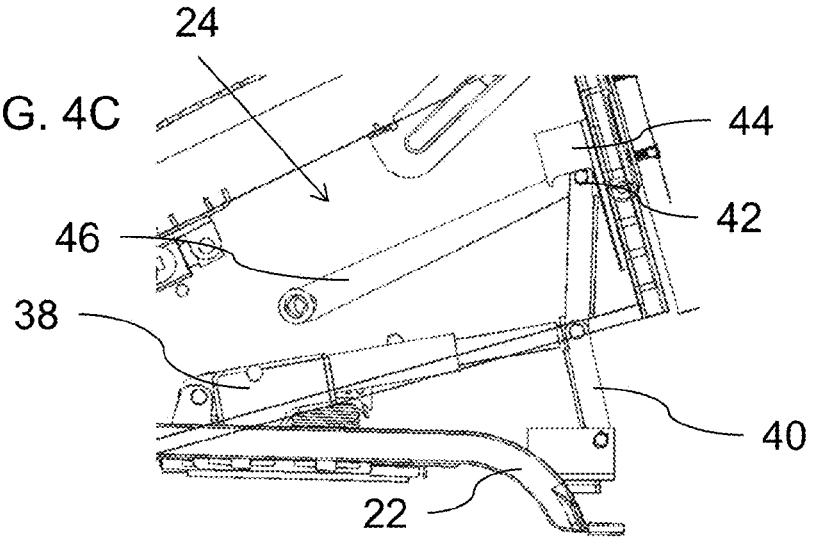
FIG. 4C is an enlarged view of the region of FIG. 3B designated IV.

In the lowered state of rocker-limiting mechanism 24 as shown in FIGS. 4A and 4B, stopper 42 is located outside the range of motion of bracket 44 during rocking motion and/or may define one end of the "normal" range of rocking motion. As actuator 38 is operated, toggle joint 40 progressively opens so as to limit the extent of the forward-tipping motion of the rocking action defined by the point at which bracket 44 reaches stopper 42. Normal rocking motion remains available in the part of the range of motion before the bracket contacts the stopper. As actuator 38 continues to open, stopper 42 bears on bracket 44 until it raises the front of chassis 12 to reach a desired maximum reclining position. Most preferably, when combined with full actuation of the recliner mechanism, this brings the body of the user into a near-horizontal resting position.

Figure 5C:
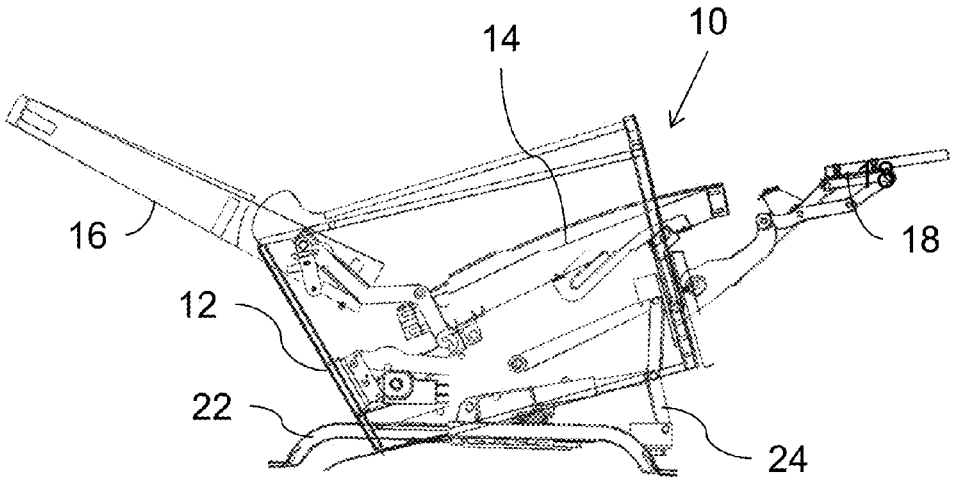
FIG. 5C is a view similar to FIG. 5B after actuation of the rocker-limiting mechanism to achieve a Zero Gravity state.

FIG. 5C is a view similar to FIG. 5B after actuation of the rocker-limiting mechanism to achieve what is referred to in the art as a "zero gravity" position in which the users feet are raised to be roughly on the same level (i.e., typically within +/−15 cm) as the user's head. As is clearly understood by comparing the states of FIGS. 5B and 5C, as well as FIGS. 3A and 3B, operation of rocker-limiting mechanism 24 is here preferably fully independent of the state of the recliner and leg rest mechanisms, allowing full independent control by the user of the degree of rearward tipping and/or the extent of available rocking motion independent of the other selected seat posture parameters.

Actuators 30, 36 and 38 may be any sort of electrical actuators capable of providing the required driving force and stable once deployed to support the required loads on the recliner. By way of one non-limiting example, a suitable step motor as an input to a step-down gear-train which operates a screw-mechanism linear actuator is believed to be suitable.

Figure 6:
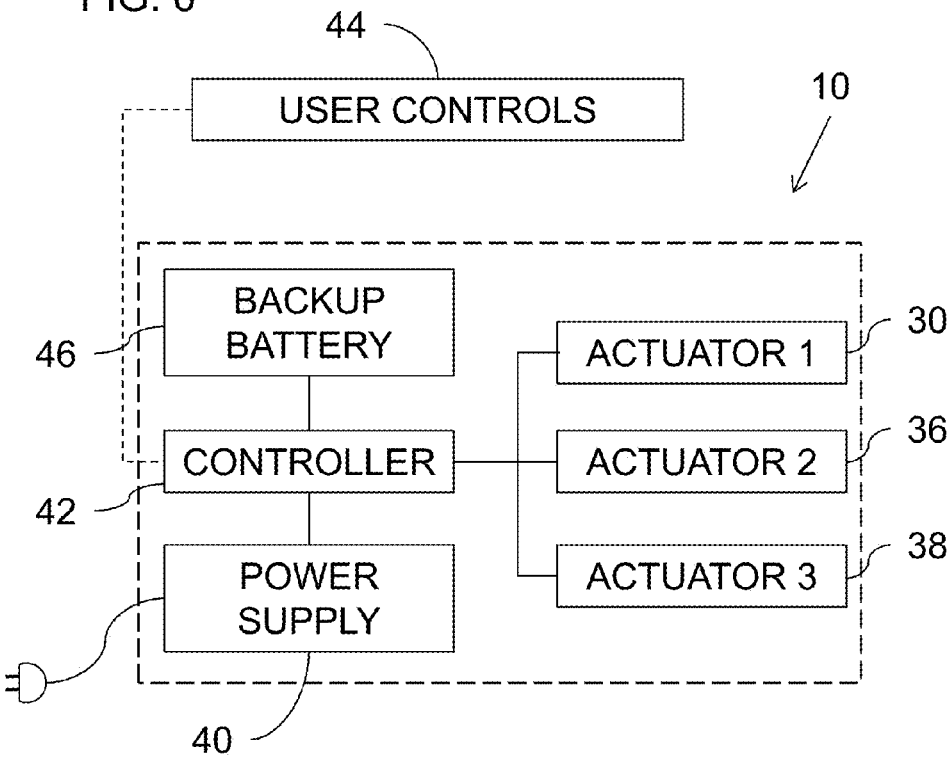
FIG. 6 is a schematic overview of the electrical components of an implementation of the recliner of FIG. 1A.

FIG. 6 shows schematically a more complete view of the electrical components of recliner 10, including a power supply 40 which typically transforms mains (AC grid) electrical power to the working voltage, typically 12V or 24V DC, which is supplied to a controller 42 which actuates each of electrical actuators 30, 36 and 38 as required. The user inputs to controller 42 are preferably entered by push-button controls on a user control panel 44, which may be built-in to recliner 10, or may be linked thereto by a wired or wireless connection. Most preferably, a backup battery 46 provides for continuing operation of recliner 10 in the case of an interruption of external power and/or where it is desired to use the recliner without a continuous connection to an external power supply.

Figure 7:
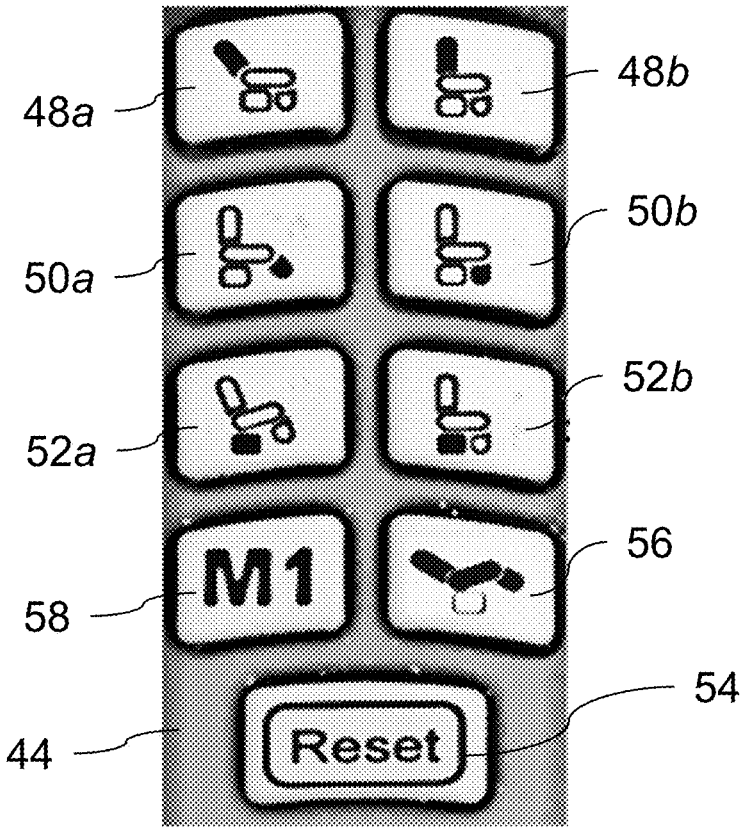
FIG. 7 is a schematic representation of a user control panel for use with the recliner of FIG. 1A.

FIG. 7 illustrates schematically an exemplary layout of buttons for user control panel 44 including back/forward buttons 48*a*, 48*b* for the recliner mechanism, extend/fold buttons 50*a*, 50*b* for the leg rest mechanism, and rearward-tip/release buttons 52*a*, 52*b* for the rocker-limiting mechanism. A "Reset" button 54 optionally provides a one-touch reset command to return recliner 10 to its neutral/upright/rocking state. A "Zero Gravity" button 56 preferably extends all three mechanisms to their fully deployed positions to achieve what is referred to in the art as a "zero gravity" position in which the user's feet are raised to be roughly on the same level (i.e., typically within +/−15 cm) as the user's head. According to a further preferred option, one or more memory button 58 can be set by the user to return to any desired combination of states of all three mechanisms, thereby returning to the user's preferred sitting position.

Although, as stated, each of the aforementioned mechanisms is independently actuated, optionally, the user control panel may additionally or alternatively feature controls which initiate adjustments which are a combination of the different motions. For example, it may be preferred to redefine buttons 48*a*, 48*b* to provide simultaneous operation of the recliner mechanism and the leg rest mechanism to achieve a regular one-touch recliner motion. Buttons 50*a* and 50*b* would then allow for separate use of the leg rest, or for partial cancellation of the deployment of the leg rest achieved using button 48*a*.

It will be appreciated that the above descriptions are intended only to serve as examples, and that many other embodiments are possible within the scope of the present invention as defined in the appended claims.

What is claimed is:

1. A recliner comprising:

(a) a base;

(b) a chassis supported via a rocker mechanism on said base so as to allow rocking of said chassis relative to said base from a neutral position alternately towards a forward-tipped position and a rearward-tipped position;

(c) a seat, a backrest and a leg rest supported relative to said chassis;

(d) an electrically controlled recliner mechanism including a first electrical actuator deployed for displacing said backrest between an upright position and a reclining position relative to said chassis;

(e) an electrically controlled leg rest mechanism including a second electrical actuator deployed for displacing said leg rest between a folded position and an extended position; and (f) an electrically controlled rocker-limiting mechanism including a third electrical actuator, said rocker-limiting mechanism being deployed such that progressive actuation of said rocker-limiting mechanism deploys from a neutral state in which said chassis is free to rock from said forward-tipped position to said rearward-tipped position through an intermediate state in which said chassis is free to rock within a limited range from said rearward-tipped position towards said neutral position to a final state in which said chassis is forced into a rearward-tipped position.

2. The recliner of claim 1, wherein said electrically controlled rocker-limiting mechanism is operable independently of both said recliner mechanism and said leg rest mechanism.

3. The recliner of claim 1, wherein said first electrical actuator is deployed to displace said seat along a track, and wherein said back rest is connected to said seat via a linkage such that sliding of said seat along said track causes displacement of said back rest from said upright position to said reclining position.

4. The recliner of claim 1, wherein, when said recliner mechanism brings said backrest to said reclining position, said leg rest mechanism brings said leg rest to said extended position and said rocker-limiting mechanism including a third electrical actuator, said rocker-limiting mechanism brings said chassis to said rearward-tipped position, said seat, said backrest and said leg rest define a user body position in which a user's feet are raised to within +/−15 cm of the level of the user's head.

* * * * *